US005161895A

United States Patent [19]

Myers

[11] Patent Number: 5,161,895

[45] Date of Patent: Nov. 10, 1992

[54] GIFT SACK WITH DRAWSTRING OR THE LIKE AND METHOD FOR MAKING THE SAME

[76] Inventor: Marion P. Myers, Rt. 2, Box 386, Purcellville, Va. 22132

[21] Appl. No.: 588,581

[22] Filed: Sep. 26, 1990

[51] Int. Cl.[5] ..... B65D 33/28

[52] U.S. Cl. ..... 383/72; 383/75; 383/113; 383/116; 383/121.1

[58] Field of Search ..... 383/71, 72, 75, 121.1, 383/107, 113, 116; 229/87.01, 87.18, 87.19, 922, 923; 206/618

[56] References Cited

U.S. PATENT DOCUMENTS

| | | | |
|---|---|---|---|
| 156,059 | 11/1849 | Vivaudou . | |
| 207,933 | 9/1878 | Arkell . | |
| 291,447 | 1/1884 | Wheeler . | |
| 293,353 | 2/1884 | Purvis . | |
| D. 296,870 | 7/1988 | Myers . | |
| D. 309,257 | 7/1990 | Myers . | |
| 361,619 | 4/1887 | Cusser | 383/75 |
| 414,679 | 11/1889 | Claussen . | |
| 656,398 | 0/0000 | Fairfax . | |
| 1,605,481 | 11/1926 | Taggart . | |
| 2,070,747 | 1/1934 | Örström . | |
| 2,376,256 | 5/1945 | Karlson . | |
| 2,710,639 | 6/1955 | Farls . | |
| 2,771,010 | 11/1956 | Piazze . | |
| 2,799,611 | 10/1957 | Dreisbach . | |
| 2,841,905 | 7/1958 | Wanchek . | |
| 3,119,549 | 1/1964 | Schoen | 383/75 X |
| 3,132,794 | 5/1964 | Frazier | 383/75 X |
| 3,285,309 | 9/1964 | Northcott . | |
| 3,301,387 | 1/1967 | Erickson . | |
| 3,373,922 | 3/1968 | Watts | 229/922 X |
| 3,475,767 | 11/1969 | Friesen et al. | 383/116 X |
| 3,568,918 | 3/1971 | Blomqvist . | |
| 3,592,379 | 7/1971 | Nakamura | 383/75 X |
| 3,632,464 | 1/1972 | Grikis . | |
| 3,637,455 | 1/1972 | Pearson et al. . | |
| 3,772,968 | 11/1973 | Ruda . | |
| 3,913,648 | 10/1975 | Sessler . | |
| 3,956,045 | 5/1976 | Hoffman | 383/107 X |
| 4,082,216 | 4/1978 | Clarke . | |
| 4,112,551 | 9/1978 | Sales . | |
| 4,270,247 | 6/1981 | Freedom . | |
| 4,276,031 | 6/1981 | Lueck . | |
| 4,329,382 | 5/1982 | Truskolaski et al. . | |
| 4,445,230 | 4/1984 | Spadaro . | |
| 4,450,028 | 5/1984 | Vilutis | 383/116 X |
| 4,476,168 | 10/1984 | Aouama . | |
| 4,515,837 | 5/1985 | Cheng . | |
| 4,547,237 | 10/1985 | Hendrickson | 383/75 X |
| 4,558,463 | 12/1985 | Boyd . | |
| 4,608,283 | 8/1986 | White . | |
| 4,721,502 | 1/1988 | Herrington . | |
| 4,777,066 | 10/1988 | White et al. | 24/712 X |
| 4,824,425 | 4/1989 | Stock . | |
| 4,832,677 | 5/1989 | Hudgens et al. . | |
| 4,850,944 | 7/1989 | Osborn . | |

FOREIGN PATENT DOCUMENTS

| | | | |
|---|---|---|---|
| 379734 | 11/1907 | France | 383/75 |
| 2409921 | 7/1979 | France | 383/75 |
| 904238 | 8/1962 | United Kingdom | 206/618 |

OTHER PUBLICATIONS

Glitterwrap Publication (catalog).
Duro Publication (catalog).

*Primary Examiner*—Stephen Marcus
*Assistant Examiner*—Jes F. Pascua
*Attorney, Agent, or Firm*—Shlesinger, Arkwright & Garvey

[57] ABSTRACT

A gift sack with a drawstring or the like member and method for making the same are disclosed. The method includes providing a sheet material of a predetermined dimension and including a heat-sealable resin-coating on one side thereof. The sheet material is spread flat on a support surface with the resin-coating facing upwardly and a heat-treatable drawstring member of a predetermined length is positioned thereon generally parallel to and along an edge portion thereof. The edge portion is folded over the drawstring about a fold line extending generally parallel to the drawstring. The sheet material portions lying adjacent the sides of the drawstring are sealed together simultaneously, without bonding the drawstring to the sheet material, by applying heat across and over the drawstring.

8 Claims, 6 Drawing Sheets

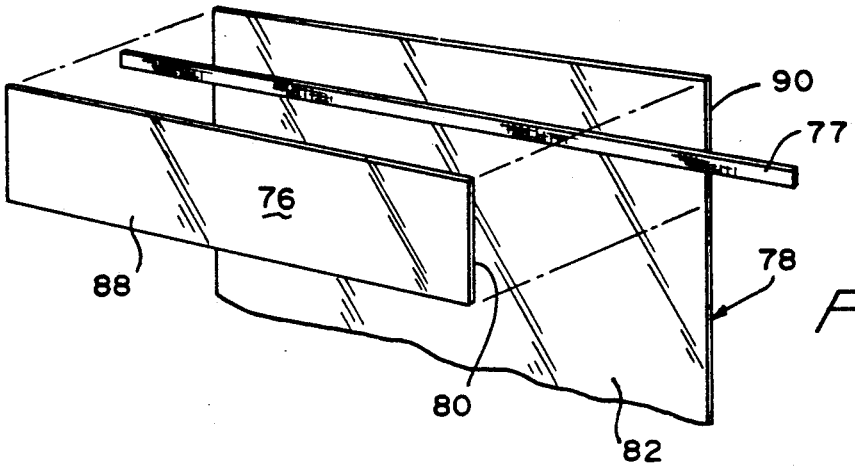
FIG. 8
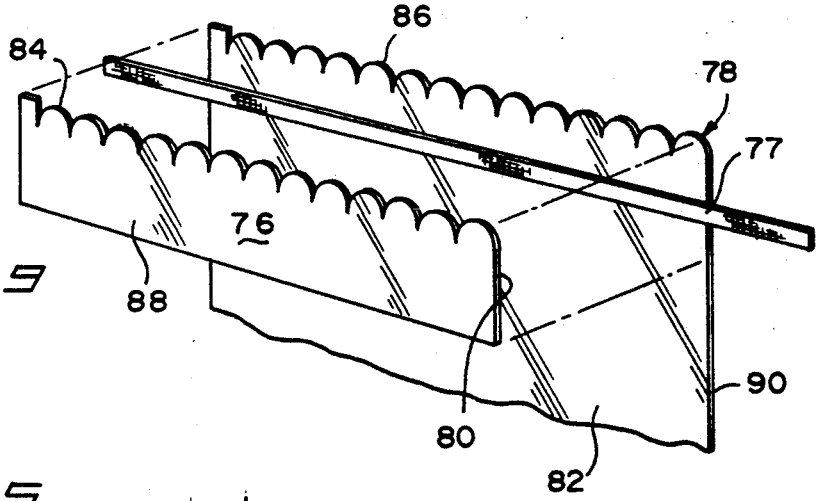
FIG. 9
FIG. 5
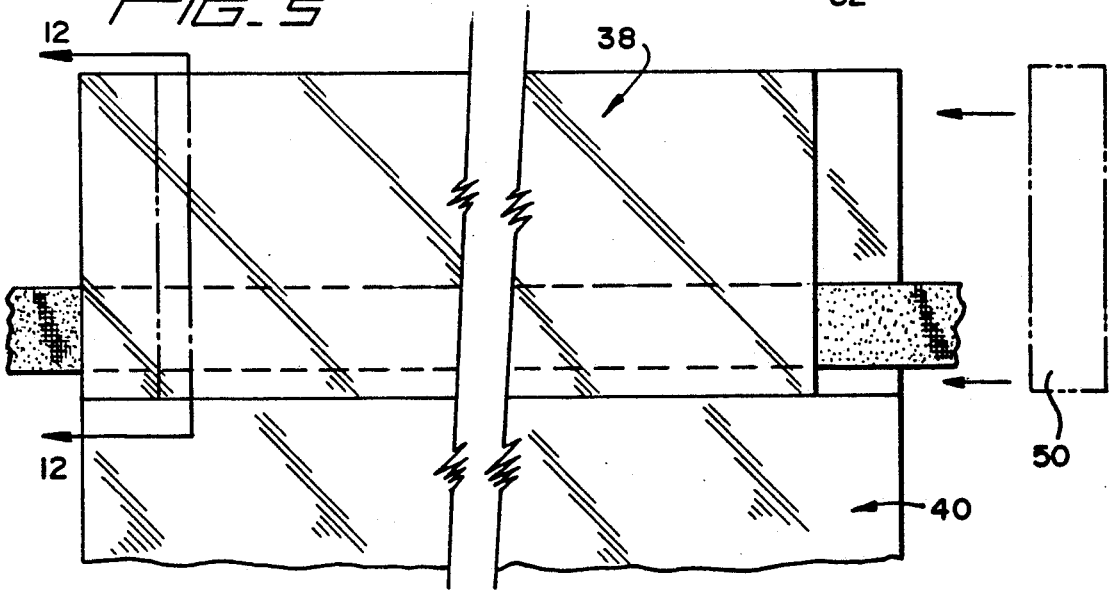

GIFT SACK WITH DRAWSTRING OR THE LIKE AND METHOD FOR MAKING THE SAME

FIELD AND HISTORICAL BACKGROUND OF THE INVENTION

The present invention is directed to gift sacks, and more particularly to a gift sack with a drawstring or the like and a method for making the same.

The aspect of wrapping articles in various types of decorative paper or the like material is no more visible than in the well-rooted custom of exchanging gifts. The industry's response to this custom has been to provide cardboard boxes in which the articles are placed and decorative paper is then wrapped and taped around the box. In order to attain this objective, boxes of varying dimensions are provided for accommodating articles of different sizes.

The conventional gift wrapping technique, however, is time-consuming, cumbersome and requires stocking a large number of boxes separate and independent from the stock of various decorative wrapping paper. In addition, it has been observed that conventional method of gift wrapping requires some training and expertise in terms of cutting the wrapping paper to size the dimensions of a given box without wastage, and then following a specific folding sequence in order to obtain a neatly and attractively wrapped package. Notwithstanding the training, it has been noted that the present technique requires a substantially long period of time in crder to gift-wrap an article.

Examples of various gift sacks, receptacles and accessories, and methods for making same are disclosed in U.S. Pat. Nos. 207,933; 291,447; 293,353; 414,679; 1,605,481; 2,376,256; 2,710,639; 2,771,010; 2,799,611; 2,841,905; 3,132,794; 3,301,387; 3,568,918; 3,632,464; 3,637,455; 3,772,968; 3,913,648; 4,112,551; 4,270,247; 4,276,031; 4,329,382; 4,445,230; 4,476,168; 4,515,837; 4,558,463; 4,608,283; 4,721,502; 4,824,425; 4,832,677; 4,850,944; Des. 156,059; Des. 296,870; Des. 309,257; and, Glitterwrap and Duro Catalogs.

In view of the drawbacks associated with conventional technique, there is a need in the art for a gift sack article which is easy to use, inexpensive to manufacture and saves time.

OBJECTS AND SUMMARY OF THE INVENTION

The principal object of the present invention is to provide a gift sack with a drawstring or the like which is easy to use, inexpensive to manufacture and does not require specialized training for wrapping various articles.

Another object of the present invention is to provide a gift sack which when wrapped produces a package having a neat and attractive appearance.

Yet another object of the present invention is to provide a gift sack which eliminates the need for separately stocking gift boxes and decorative gift wrap paper.

An additional object of the present invention is to provide a gift sack which eliminates the need for stocking a large number of gift boxes for accommodating articles of various dimensions.

Yet additional object of the present invention is to provide a gift sack which can be used repeatedly.

Still yet an additional object of the present invention is to provide a gift sack which is easy to open and close for gaining access to the article contained therein.

A further object of the present invention is to provide a gift sack which can be easily folded into a compact dimension for shipping and further requires minimal storing or shelf space.

Yet a further object of the present invention is to provide gift sack which eliminates the need for accessory items, such as scissors, adhesive tape, etc.

Still yet a further object of the present invention is to provide a gift sack which is self-contained and eliminates the use of various accessory items, such as boxes, ribbons, decorative bows, wrapping paper, etc., in order to gift wrap an article.

Another object of the present invention is to provide a method of making a gift sack with a drawstring or the like.

Yet another object of the present invention is to provide a unique method of attaching a drawstring or the like member to a sheet material for making a gift sack.

An additional object of the present invention is to provide a gift sack wherein a drawstring is made of a material that prevents its bonding to the heat-sensitive resin-coating provided on the bag forming material, when heat is applied for securing the drawstring to the bag. The drawstring therefore remains free to slide between the bag forming panels upon completion of the bag assembly.

Yet an additional object of the present invention is to provide a gift sack wherein a lubricating or release agent, or the like, is applied to the bag forming material, or to the drawstring, in order to prevent bonding of the bag material and the drawstring when heat is applied for securing the drawstring to the bag. The drawstring therefore remains free to slide between the bag forming panels upon completion of the bag assembly.

In summary, the main object of the present invention is to provide a gift sack with a drawstring or the like and a method of making the same.

BRIEF DESCRIPTION OF THE DRAWINGS

The above and other objects and advantages and novel features of the present invention will become apparent from the following detailed description of the preferred embodiment of the invention, illustrated in the accompanying drawings, wherein:

FIGS. 2-7 illustrate various steps of attaching a drawstring or the like to a sheet material for making the gift sack in accordance with the method of the invention;

FIG. 8 illustrates an alternative embodiment of the method of attaching a drawstring or the like to a sheet material for making the gift sack of the present invention;

FIG. 9 illustrates an embodiment similar to the embodiment shown in FIG. 8, wherein gift sack opening has scalloped edge;

DETAILED DESCRIPTION OF THE INVENTION

Figure 1:
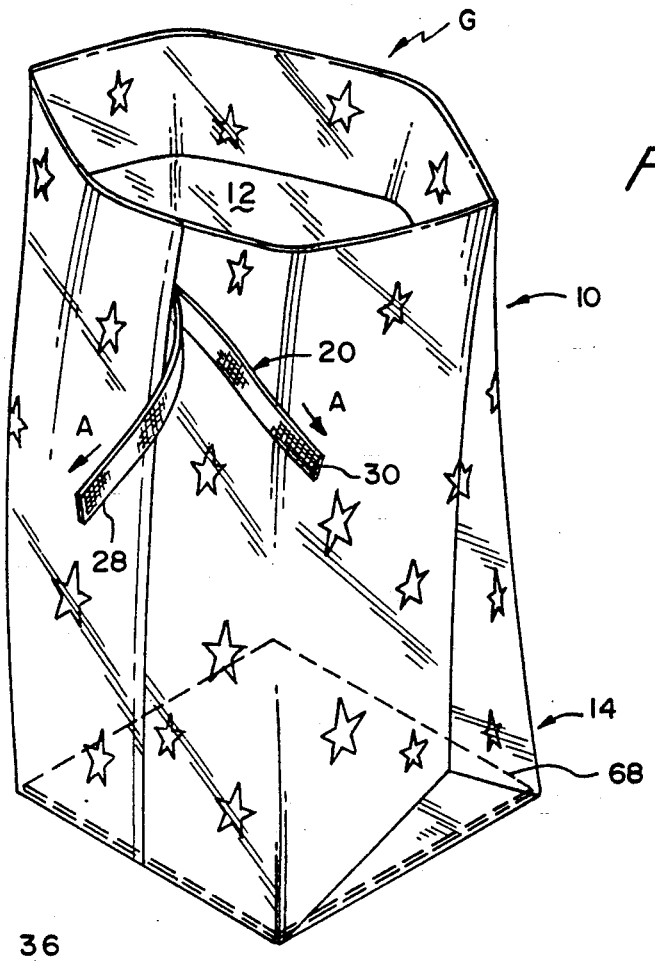
FIG. 1 is a perspective view of a gift sack of the present invention.
Figure 10:
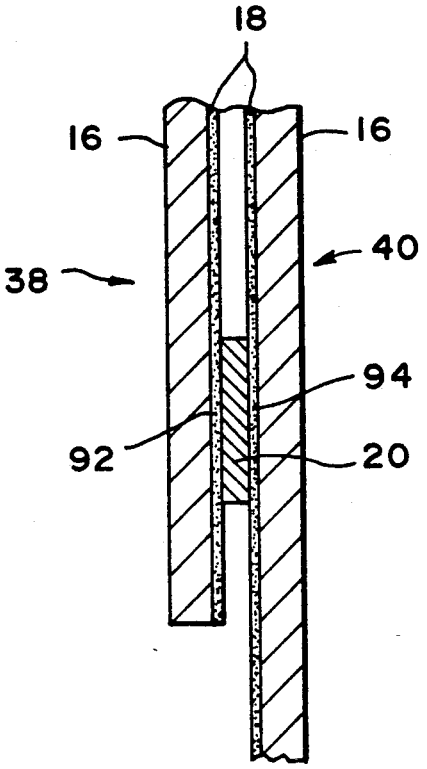
FIGS. 10 and 11 are partial, enlarged sectional views along line 10—10 of FIG. 3, taken before and after heat-sealing steps, respectively.

As illustrated in FIG. 1, gift sack G includes a top portion 10 with opening 12 and a closed bottom portion 14. The sack G may be made of any suitable material that has a backing layer 16 made of a conventional material, such as foil, paper, plastic or the like, and has a heat-sealable resin-coating 18 applied thereto on one surface thereof (see FIG. 10). The coating 18 is made of any suitable thermoplastic polymeric/resin material, and functions as an adhesive to bond two portions of the bag, as described below in detail. The backing 16 may have surface color or decoration applied thereto on the side opposite to resin-coating (18) side. The top portion 10 includes a drawstring or drawtape 20 or the like member which when pulled in the direction of arrows A, shown in FIG. 1, closes opening 12 by gathering top portion 10.

Figure 2:
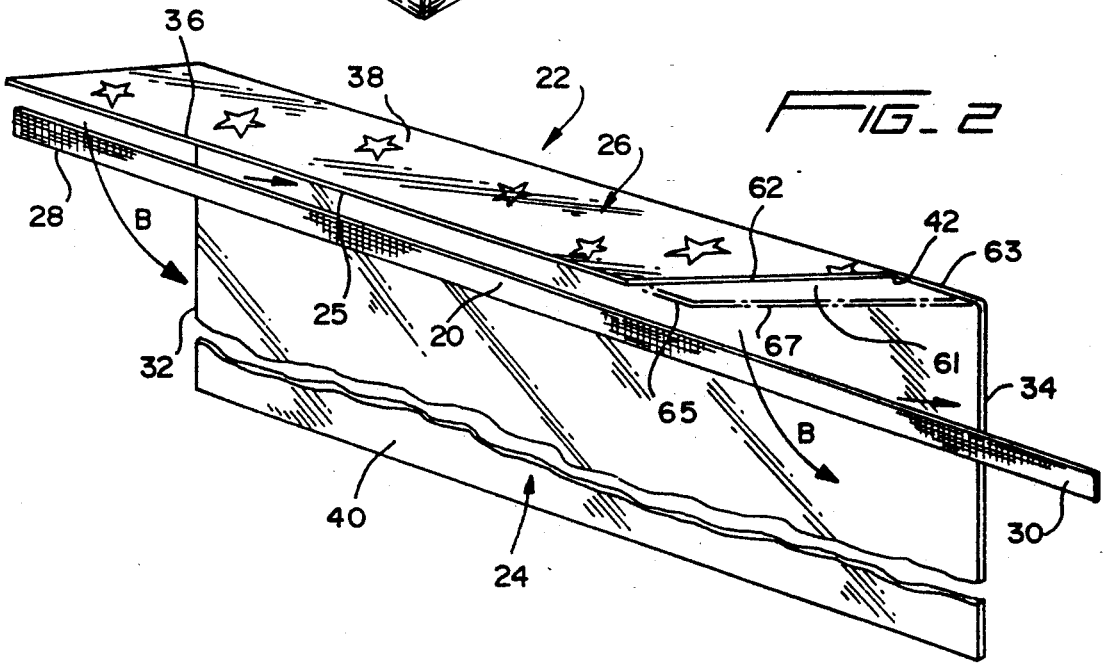
Figure 3:
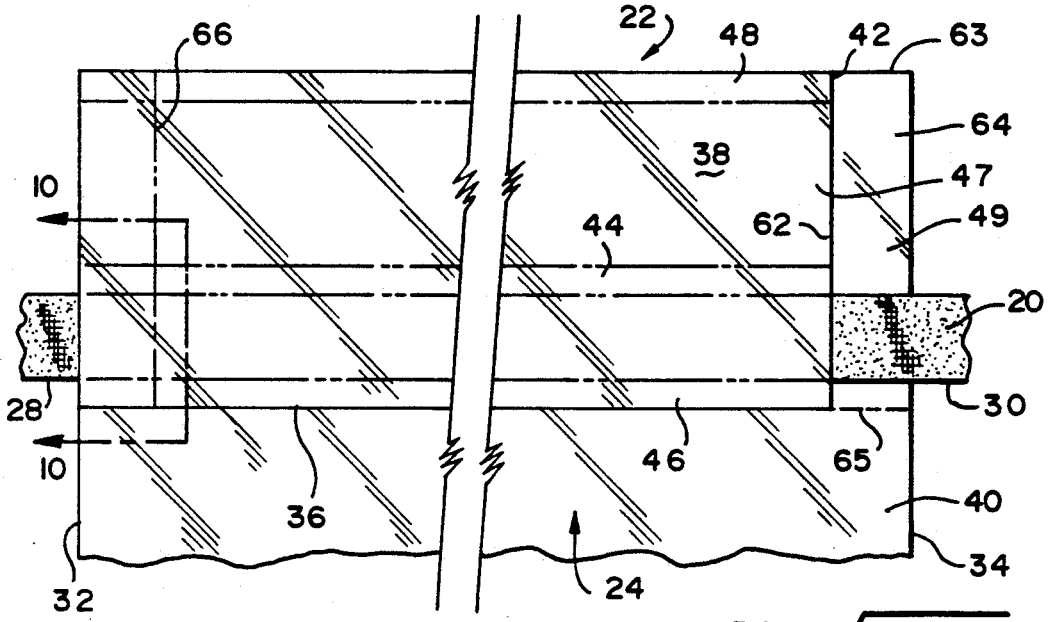

As shown in FIG. 2-3, the method of making gift sack G of the present invention includes first securing drawstring 20 to a bag forming panel 22 of a suitable material as described above. The panel 22 is of a dimension that would produce a sack of a predetermined size. The panel 22 is then spread flat on a support surface (not shown) with the resin-coating side 24 facing up and print side 26 facing the support surface (print omitted from FIGS. 3, 5-9 for clarity). The drawstring or drawtape 20 of a suitable width, preferably one inch, is then placed across panel 22 on side 24 such that drawstring ends 28 and 30 extend past side edges 32 and 34 of panel 22, respectively. It is preferable that drawstring ends 28 and 30 each extend past side edges 32 and 34 by at least five inches. The drawstring 20, it should be noted, is positioned so as to be parallel to top edge 36 of panel 22. The portion 38 of panel 22 that lies adjacent edge 36 and on one side of fold line 42 is then folded over inwardly about fold line 42, as indicated by arrows B in FIG. 2, so as to overlie drawstring 20 and lower portion 40. In this manner, the resin-coating side 25 of upper portion 38 directly faces resin-coating side 24 of lower portion 40.

The drawstring 20 is made of nylon or a suitable heat-treatable resinous material. It should be noted, however, that although drawstring 20 is made of a heat-treatable material, it is non-bondable with resin-coating 18.

Figure 11:
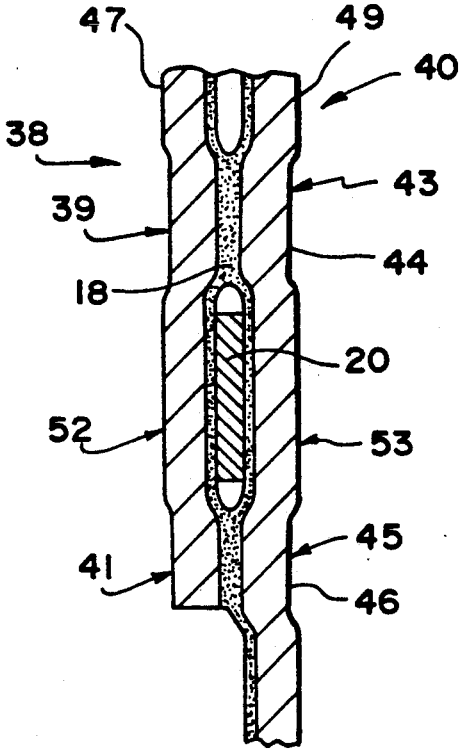

As shown in FIGS. 3 and 11, heat is then applied across and over drawstring 20 by using conventional means (not shown), in order to seal simultaneously sections 39 and 41 of upper portion 38 with corresponding underlying sections 43 and 45 of lower portion 40, lying adjacent the sides of drawstring 20 thereby providing seal or bonding strips 44 and 46 (FIG. 3). The top edge portion 36 may then also be sealed to provide top seal or bonding strip 48. The sections 47 and 49 of upper and lower portions 38 and 40, respectively, lying between seal strips 44 and 48, therefore, remain unbonded (see FIG. 11). Unbonded section 47 defines a ruffle-forming portion which forms a ruffle when drawstring 20 is pulled to close opening 12 by gathering top portion 10.

Figure 12:
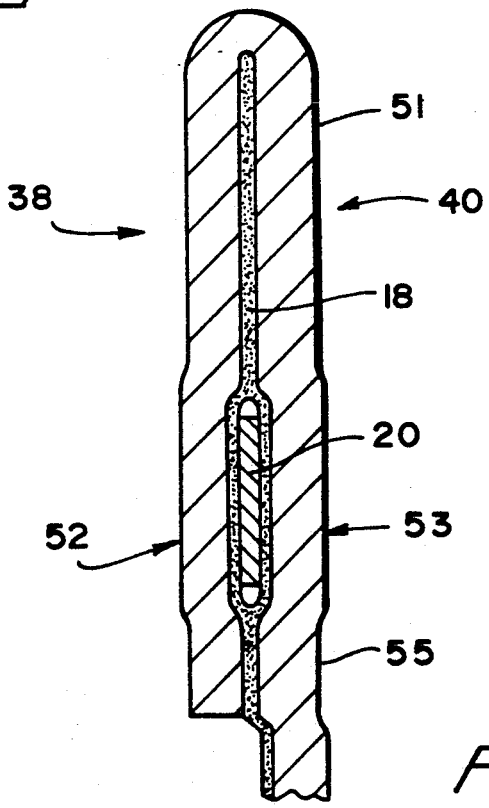
FIG. 12 is an enlarged view taken along line 12—12 of FIG. 5 after heat has been applied.

The heat-sealing step is preferably carried out by passing a hot-roller 50 across the entire upper portion 38 such that the entire upper and lower portions 38 and 40 are sealed together simultaneously, as shown in FIGS. 5 and 12, thereby forming upper and lower seal or bonding strips 51 and 55, respectively. The upper strip or ruffle forming portion 51 is considerably wider than lower strip 55. Accordingly, when drawstring 20 is pulled to close bag opening 12, upper wider strip 51 forms an attractive ruffle. Preferably, the width of strip 51 is about two to four inches.

Figure 4:
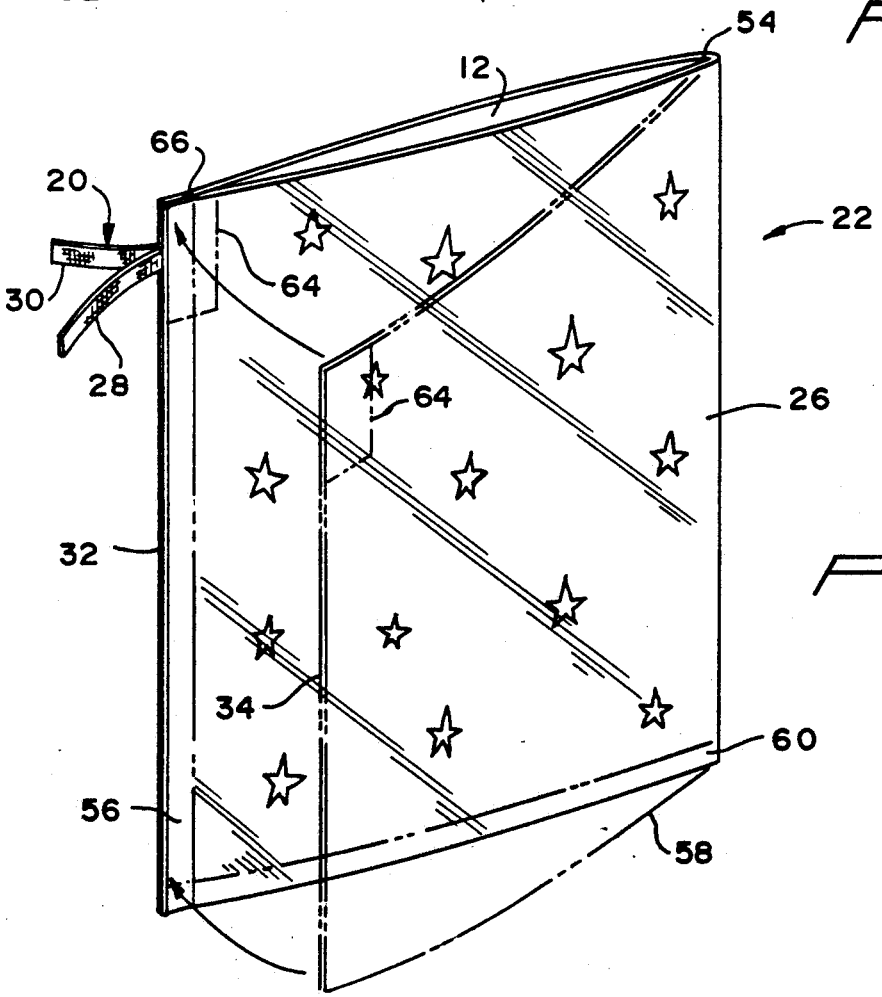

It should be noted, however, that since drawstring 20 is made of a material that does not bond with resin-coating 18, the sections 52 and 53 of upper and lower portions 38 and 40, respectively, that over and underlie drawstring 20, do not bond together and drawstring 20 remains free to slide therebetween, shown in FIGS. 11 and 12. The panel 22 is then folded in half about vertically extending fold line 54 such that right side edge 34 thereof overlies left side edge 2, and are sealed together to form seal or bonding strip 56, shown in FIG. 4. The bottom edge portion 58 of panel 22 is likewise sealed to form bottom seal or bonding strip 60.

As shown in FIGS. 2 and 3, a side strip 61 bound by edges 62, 63, 65 and 67, preferably one-half inch in width, is cut-out from upper portion 38 of panel 22 before heat-sealing upper and lower portions 38 and 40. This leaves a corresponding underlying strip 64 of lower portion 40 unsealed when heat is applied over drawstring 20 to bond portion 38 and 40 together. Therefore, when panel 22 is folded in half, the resin-coating 18 on strip 64 comes into contact with corresponding portion 66 of upper portion 38 lying adjacent side edge 32 of panel 22, and is sealed therewith when heat is applied.

Figure 6:
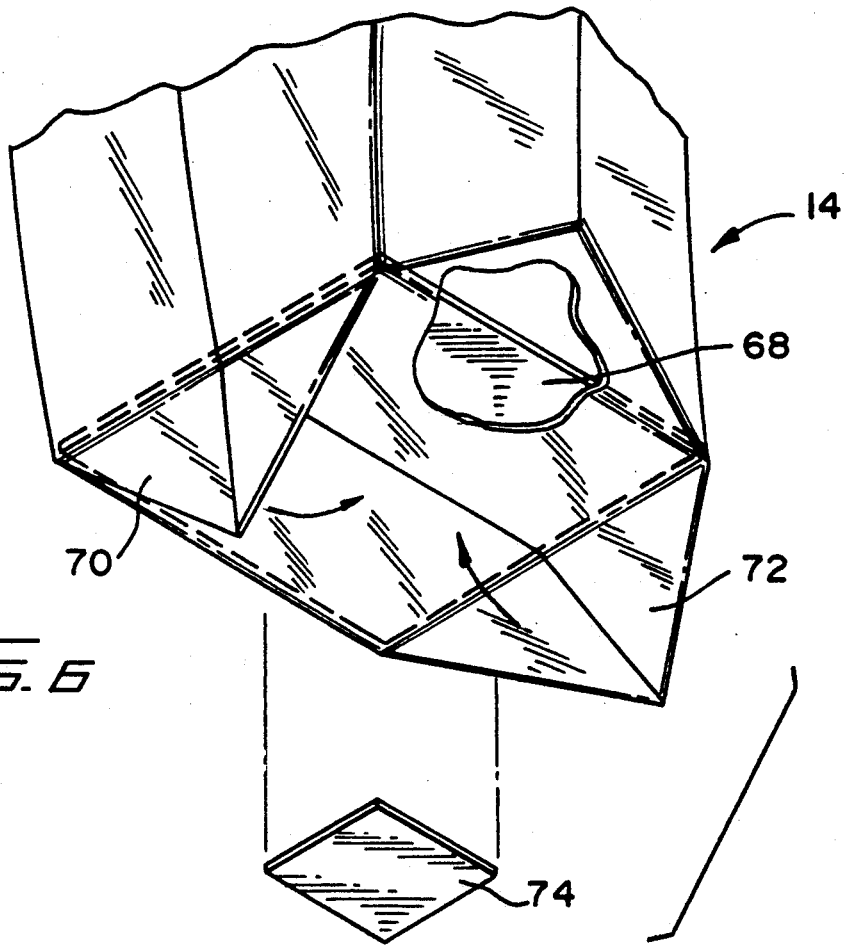
Figure 7:
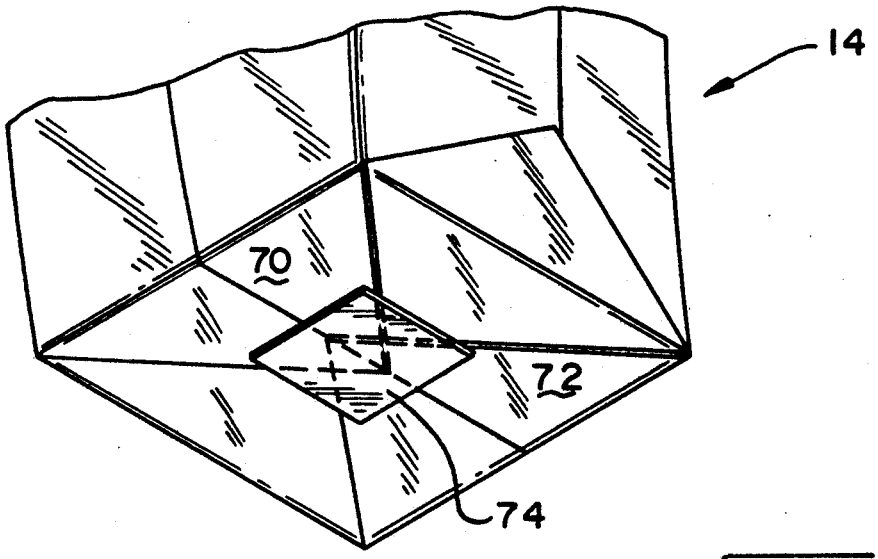

Subsequently, a base 68, preferably made of a cardboard material and square in dimension, is placed inside the sack thus formed for creating a gift sack with a defined bottom, shown in FIG. 6. The bottom end portions 70 and 72 are subsequently folded underneath base 68 and sealed together in the conventional manner by placing a self-adhesive sticker 74 or the like.

FIGS. 8 and 9 illustrate an alternative method of making the gift sack G of the invention. In particular, the fold-over upper portion 38 shown in FIG. 2, is substituted by a separate panel 76 that is positioned over drawstring 77 having been earlier placed on bag-forming panel 78. Both panels 76 and 78 are made of a like material that has a backing layer with a resin-coating on one side thereof. The panel 76 is placed such that the resin-coating side 80 thereof faces the resin-coating side 82 of panel 78, and the two panels are heat sealed in the manner described above.

FIG. 9 discloses an embodiment of gift sack G shown in FIG. 8, where the top edges of over-panel 76 and bag forming panel 78 have scalloped edges 84 and 86, respectively. This arrangement produces a bag with a scalloped edge opening. It should be noted that over-panel 76 would be disposed on the inside perimeter of bag opening 12, when the gift sack has been sealed and fully assembled. Therefore, it may be desirable to omit any printing or color from the side 88 of panel 76 which lies opposite to the resin-coating side 80 thereof.

Preferably, side 88 of over-panel 76 is silver colored with no printing and side 80 thereof includes decorative printing thereon. Likewise, side 82 of bag-forming panel 78 is silver colored with no printing, and side 90 thereof includes printing thereon.

While it is not necessary to apply a chemical (lubricating) or release agent to drawstring 20 or 77 to prevent its bonding with the resin-coating on the bag forming material, it may be desirable in certain circumstances to do the same. More specifically, talc, talcum powder, or the like material can be sprayed onto the sections of bag-forming panels 22 or 78 that over and underlie drawstring 20 or 77 so that when heat is applied, the drawstring 20 or 77 remains unbonded to the bag-forming material.

Figure 13:
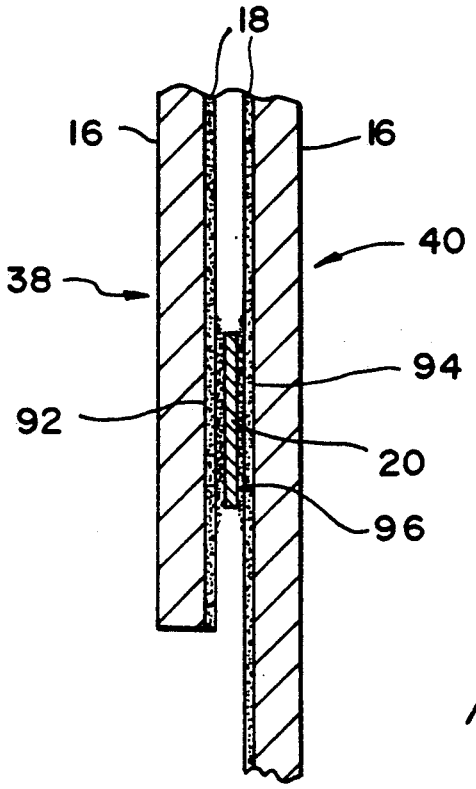
FIG. 13 is a view similar to FIG. 10 showing an alternate embodiment wherein a lubricant has been applied between the drawstring and the sections of the gift sack making material under and overlying the drawstring.

For example, in the embodiment disclosed in FIG. 13, a lubricant 96 has been applied on sections 92 and 94 of facing surfaces 18 of each of upper and lower portions 38 and 40, respectively, prior to positioning drawstring 20.

It should be noted that it is not necessary that both over-panel 76 and bag-forming panel 78 include a resin-coating applied on one side thereto. In other words, it is sufficient that either the side 80 of panel 76 facing panel 78, or the side 82 of panel 78 facing panel 76 has the resin-coating such that when heat is applied, panels 76 and 78 are sealed together.

Figure 14:
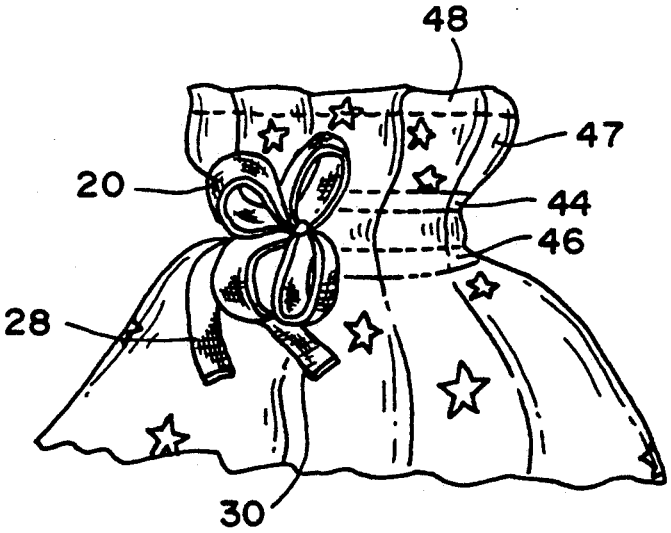
FIG. 14 is a partial perspective view of the gift sack of FIG. 1 after the drawstring has been pulled.

In use, a user simply needs to place an article inside the gift sack G through top opening 12 and pull drawstring ends 28 and 30, as shown by arrows A in FIG. 1. The pulling forces cause drawstring 20 to constrict top opening 12 and gather top portion 10 in the known manner. The drawstring ends 28 and 30 can then be tied together to form a bow for making a decorative package. FIG. 14 shows a top portion of gift sack G after the drawstring has been pulled in direction A and the bow has been tied in the known manner, seal strip 48, unbonded section 47, seal strip 44, drawstring 20, and seal strip 46 being shown in hidden line.

While this invention has been described as having preferred designs, it is understood that it is capable of further modifications, uses, and/or adaptations of the invention, and including such departures from the present disclosure as come within known or customary practice in the art to which the present invention pertains, and as may be applied to essential features hereinbefore set forth, and fall within the scope of the invention or the limits of the claims appended hereto.

What I claim is:

1. A closure bag with a drawstring or the like, comprising:

a) a bag having a top portion with an opening and a closed bottom portion;

b) said top portion including first and second sheet panels disposed in overlying relationship to one another and each including inside and outside surfaces;

c) each of said first and second sheet panels including inside and outside surfaces;

d) said upper edges of said first and second sheet panels extending up to said top opening of said bag;

e) at least one of said first and second sheet panels including a heat-sealed resin-coating on the entire inside surface thereof and extending from the corresponding upper edge to the lower edge thereof;

f) the inside surface of the other of said first and second sheet panels being bonded to said resin-coating;

g) a drawstring member of a predetermined length and formed of a heat-treatable material, but unbonded to said resin-coating throughout the length thereof, disposed between said first and second panels;

h) said top portion including first and second bonding strips on either side of said drawstring member;

i) said top portion including a ruffle-forming portion including a third bonding strip disposed at said opening and spaced at a predetermined distance from said first and second bonding strips, said predetermined distance defining an unbonded top area;

j) said first and second panels being bonded to one another along said first and second bonding strips on either side of said drawstring member, but unbonded in the areas thereof substantially overlying and underlying said drawstring member; and k) wherein, when said drawstring member is pulled to close said opening of said top portion said ruffle-forming portion forms a ruffle.

2. The bag of claim 1, wherein:

a) said drawstring member is positioned a substantial distance away from said opening of said top and in surrounding relationship thereto.

3. The bag of claim 1, wherein:

a) said opening of said top has a perimeter edge; and b) said perimeter edge is scalloped.

4. A closure bag with a drawstring or the like, comprising:

a) a bag having a top portion with an opening and a closed bottom portion;

b) said top portion including first and second sheet panels disposed in overlying relationship to one another and each including inside and outside surfaces;

c) each of said first and second sheet panels including upper and lower edges;

d) said upper edges of said first and second sheet panels extending up to said top opening of said bag;

e) at least one of said first and second sheet panels including a heat-sealed resin-coating on the entire inside surface thereof and extending from the corresponding upper edge of the lower edge thereof;

f) the inside surface of the other of said first and second sheet panels being bonded to said resin-coating;

g) a drawstring member of a predetermined length, unbonded to said resin-coating throughout the length thereof, disposed between said first and second panels and adjacent said resin-coating;

h) said top portion including at least one bonding strip on either side of said drawstring member;

i) one of said at least one bonding strips extending generally between said drawstring member and the top opening in a surrounding relationship to the bag;

j) said one of said at least one bonding strips defining a ruffle-forming portion;

k) said first and second panels being bonded to one another along said at least one bonding strip on either side of said drawstring member, but unbonded in the areas thereof substantially overlying and underlying said drawstring member; and l) wherein, when said drawstring member is pulled to close said opening of said top portion said ruffle-forming portion forms a ruffle.

5. The bag of claim 4, wherein:

a) said drawstring member comprises a nylon material.

6. The bag of claim 4, wherein:

a) said drawstring member comprises a resin material;

b) a chemical agent has been applied to inside surfaces of said first and second panels in the areas substantially overlying and underlying said drawstring member prior to the bonding of said first and second panels to prevent bonding of said drawstring member to said first and second panels; and c) said chemical agent includes a talc material.

7. The bag of claim 4, wherein:

a) said drawstring member includes first and second ends; and b) said drawstring member is slidably disposed between said first and second panels in a surrounding relationship to the bag and said first and second ends of said drawstring member suspend freely.

8. The bag of claim 4, wherein:

a) said bag includes a bottom defining member of a generally rigid material placed inside said bottom portion of said bag.

* * * * *